United States Patent [19]

Steinberger

[11] Patent Number: 4,704,936

[45] Date of Patent: Nov. 10, 1987

[54] TREMOLO WITH LEVER ANGLE CONTROL

[75] Inventor: Ned Steinberger, Cornwall, N.Y.

[73] Assignee: Steinberger Sound Corporation, Newburgh, N.Y.

[21] Appl. No.: 787,444

[22] Filed: Oct. 15, 1985

Related U.S. Application Data

[63] Continuation-in-part of Ser. No. 656,501, Oct. 1, 1984, Pat. No. 4,632,005.

[51] Int. Cl.[4] ..... G10D 3/12

[52] U.S. Cl. ..... 84/313; 84/267; 84/297 R

[58] Field of Search ..... 84/297 R, 312 R, 313

[56] References Cited

U.S. PATENT DOCUMENTS

| | | | |
|---|---|---|---|
| 542,719 | 7/1895 | Wahner | 84/297 S |
| 2,201,869 | 5/1940 | Nickel | 84/297 R |
| 2,241,911 | 5/1941 | Kauffman | 84/313 |
| 2,972,923 | 2/1961 | Fender | 84/313 |
| 3,248,991 | 5/1966 | Cole | 84/313 |
| 3,411,394 | 11/1968 | Jones | 84/313 |
| 3,466,962 | 9/1969 | Cole | 84/312 R |
| 3,695,137 | 10/1972 | Eurich | 84/312 R |
| 3,910,151 | 10/1975 | Copeland | 84/267 |
| 4,170,161 | 10/1979 | Kaftan | 84/312 R |
| 4,171,661 | 10/1979 | Rose | 84/313 |
| 4,383,466 | 5/1983 | Shibuya | 84/313 |
| 4,453,443 | 6/1984 | Smith | 84/298 |
| 4,457,201 | 7/1984 | Storey | 84/313 |
| 4,608,905 | 9/1986 | Takabayashi | 84/313 |
| 4,610,190 | 9/1986 | Maloney | 84/312 R |
| 4,632,005 | 12/1986 | Steinberger | 84/313 |
| 4,649,788 | 3/1987 | Matsui | 84/297 R |

*Primary Examiner*—Lawrence R. Franklin

*Attorney, Agent, or Firm*—Finnegan, Henderson, Farabow, Garrett & Dunner

[57] ABSTRACT

An even tuning tremolo system for a stringed musical instrument has a body, a neck extending from the body, and strings having a neck end, a body end, and a body end portion extending from the body end. A nut and bridge define the vibrating portion of the strings. A tremolo tail piece pivots about a pivot point and anchors one end of each string while varying the absolute pitch of the strings and maintaining the relative pitch of the strings during pivoting. The strings are anchored at different relative lever angles, the lever angle defined as the lever angle formed between the body end portion of the string and a line segment between the body end of the string and the pivot point.

21 Claims, 8 Drawing Figures

TREMOLO WITH LEVER ANGLE CONTROL

RELATED APPLICATIONS

This application is a continuation-in-part of commonly assigned U.S. patent application Ser. No. 656,501 filed Oct. 1, 1984 now U.S. Pat. No. 4,632,005, issued Dec. 30, 1986, by Ned Steinberger for "Tremolo Mechanism for an Electric Guitar" the disclosure of which is hereby incorporated into this application by reference.

BACKGROUND OF THE INVENTION

1. Field of the Invention

This invention relates to stringed musical instruments, and more particularly, to a mechanism for producing an even tuning tremolo effect in a stringed musical instrument.

2. Description of the Related Art

Tremolo devices have been used for many years with stringed musical instruments for creating a vibrato sound. Various structures have been proposed and utilized for this purpose.

Broadly, a tremolo mechanism allows the musician to change the tension on all of the strings of the instrument simultaneously to create a pitch change during vibration of the strings. Typically, a moving tailpiece on the body of a guitar is utilized to accomplish this tension change. In such a mechanism, a pivot point is established and the tailpiece pivots about that point. A counterspring may be utilized to counteract the pull of the strings on the tailpiece; as disclosed in U.S. Pat. No. 4,632,005. A handle is generally provided for pivoting the tailpiece while simultaneously playing the instrument.

One of the most significant problems in tremolo devices relates to the inability to maintain pitch relationship between the individual strings. The devices which are known typically move all strings of the instrument the same distance when the mechanism is actuated. Since the higher pitch strings of the instrument generally have much more stretch than the lower pitch strings, the lower pitch strings generally change pitch more readily. For example, if a chord is played on the instrument and the tremolo mechanism is actuated, the lower pitch strings of the instrument change pitch faster than the higher pitch strings, and the pitch relationships within the chord are lost.

Various proposals have been made to correct this shortcoming. For example, U.S. Pat. No. 3,411,394 to Jones discloses a tremolo system in which the tail end of each string can be fixed at different relative distances from the pivot point of the tremolo tailpiece so that the end of each string can be displaced through a greater or lesser distance relative to the other strings. Even though the end of each string rotates through the same angle relative to the pivot point, this differential displacement occurs because strings positioned at a greater radial distance from the pivot point are translated over a longer distance than strings positioned at a lesser radial distance from the pivot point.

In such a manner, some of the shortcomings in conventional tremolo systems have been overcome. However, provisions for accommodating other characteristics of the strings are not made. Therefore, known arrangements do not satisfactorily provide a tremolo system for varying the absolute pitch of the strings while maintaining the relative pitch of the strings during pivoting of the tailpiece.

Accordingly, it is the primary object of this invention to provide an improved even tuning tremolo system for varying the absolute pitch of the strings of a musical instrument while maintaining the relative pitch of the strings during pivoting of the tailpiece to which the strings are attached.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, an even tuning tremolo system is provided for a stringed musical instrument having a body, a neck extending from the body, and strings having a neck end and a body end, comprising: nut means on the neck and bridge means on the body for defining the vibrating portion of the strings; a tremolo tailpiece mounted on the body, the tailpiece including means for pivoting the tailpiece within a range of pivoting positions relative to the body about a pivot point; and means for anchoring the body end of each string to the tremolo tailpiece, for varying the absolute pitch of the strings and maintaining the relative pitch of the strings during pivoting of the tailpiece, and for maintaining at least one string at a different lever angle relative to at least one of the other strings.

The varying and maintaining means preferably includes means for maintaining a rate of change of tension in at least one of the strings that is different from a rate of change of tension in at least one of the other strings when the tailpiece is pivoted around the pivot point. The varying and maintaining means also preferably includes means for maintaining a change in the rate of change of tension in at least one of the strings that is different from a change in the rate of change of tension in at least one of the other strings when the tailpiece is pivoted around the pivot point.

In accordance with the present invention there also is provided an even tuning tremolo system for a stringed musical instrument, the instrument having a body and a neck extending from the body, the system comprising: a plurality of strings of substantially equal length extending over at least a portion of the body, each string having a neck end and a body end; a neck ball fastened to the neck end of each string; a body ball fastened to the body end of each string; nut means on the neck and bridge means on the body for defining the vibrating portion of the strings; means for securing the neck ball end of each string to the neck of the instrument, the neck ball of at least one string being secured at a different distance from the nut means relative to the neck ball of at least one other string; a tremolo tailpiece mounted on the body, the tailpiece including means for pivoting the tailpiece relative to the body about a pivot point; and means for anchoring the body end of each string to the tremolo tailpiece, for varying the absolute pitch of the strings and maintaining the relative pitch of the strings during pivoting of the tailpiece.

In accordance with the purposes of the invention, there also is provided an even tuning tremolo system for a stringed musical instrument, the musical instrument having a body and a neck extending from the body, the system comprising: a plurality of strings of different relative lengths extending over at least a portion of the body, each string having a neck end and a body end; a neck ball fastened to the neck end of each string; a body ball fastened to the body end of each string; nut means on the neck and bridge means on the body for defining the vibrating portion of the strings; means for securing the neck end of each string to the neck of the instrument at an equal distance from the nut means; a tremolo tailpiece mounted on the body, the tailpiece including pivot means for pivoting the tremolo tailpiece relative to the body about the pivot point; and means for anchoring the body end of each string to the tremolo tailpiece for varying the absolute pitch of the strings and maintaining the relative pitch of the strings during pivoting of the tailpiece.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIENTS

Reference will now be made in detail to the present preferred embodiments of the invention as illustrated in the accompanying drawings.

In accordance with the present invention, there is provided an even tuning tremolo system for a stringed musical instrument having a body, a neck extending from the body, and strings having a neck end and a body end, comprising: nut means on the neck and bridge means on the body for defining the vibrating portion of the strings; a tremolo tailpiece mounted on the body, the tailpiece including means for pivoting the tailpiece within a range of pivoting positions relative to the body about a pivot point; and means for anchoring the body end of each string to the tremolo tailpiece, for varying the absolute pitch of the strings and maintaining the relative pitch of the strings during pivoting of the tailpiece, and for maintaining at least one string at a different lever angle relative to at least one of the other strings, the lever angle defined as the angle formed between the body end portion of the string and the line segment between the body end of the string and the pivot point.

Figure 1:
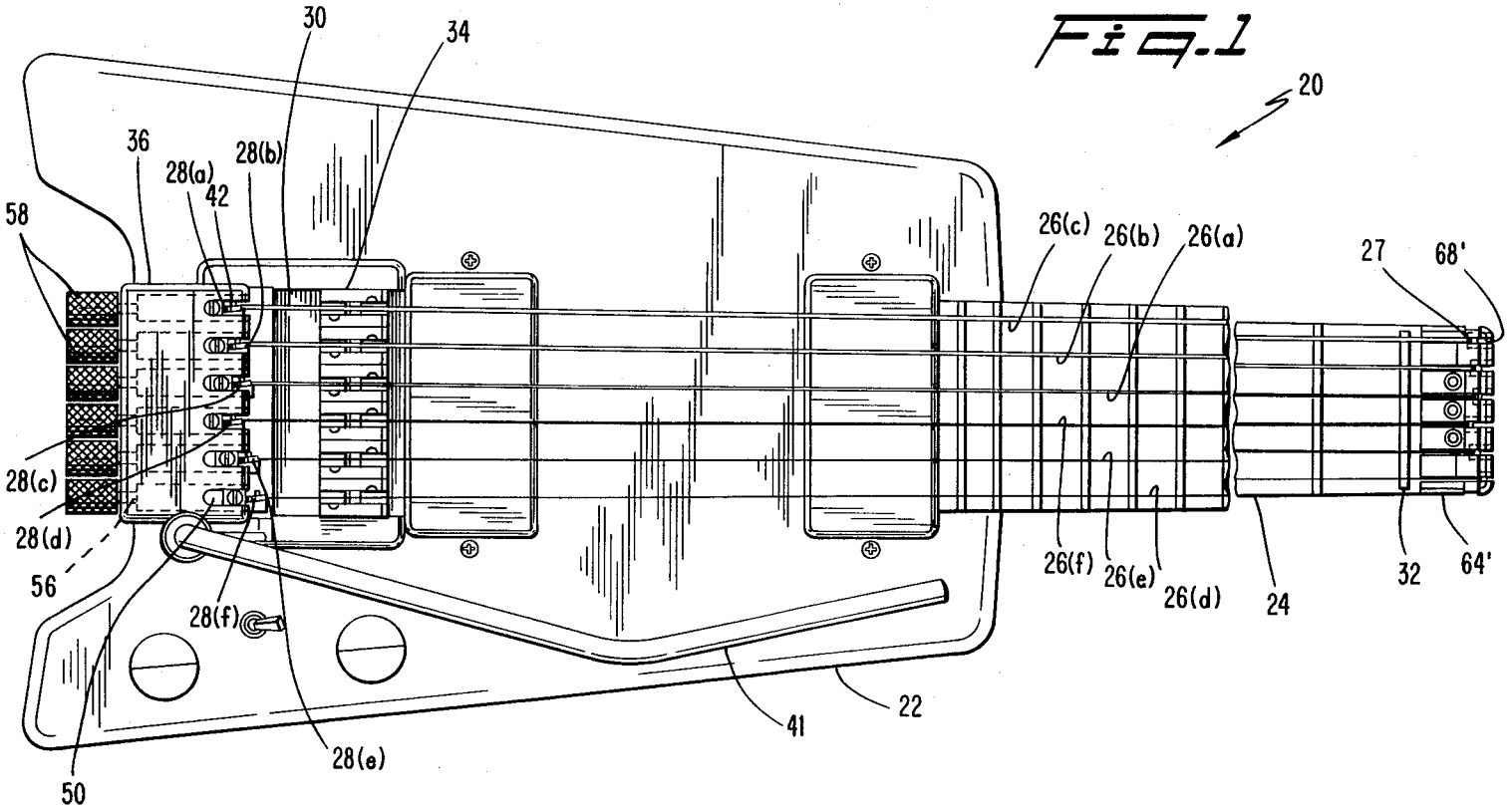
FIG. 1 is a plan view of an embodiment incorporating the teachings of the present invention.

In FIG. 1, the stringed musical instrument is shown as a guitar 20 having a body 22, a neck 24 extending from body 22, and strings 26. Each string has a neck end 27, a body end 28 and a body end portion 30 extending from the body end. Nut means such as nut 32 is located on the neck 24 for defining the neck end of the vibrating portions of the strings. Bridge means such as bridge 34 is located on the body 22 for defining the body end of the vibrating portion of the strings. A tremolo tailpiece 36 is mounted on the body 22.

Figures 2, 8:
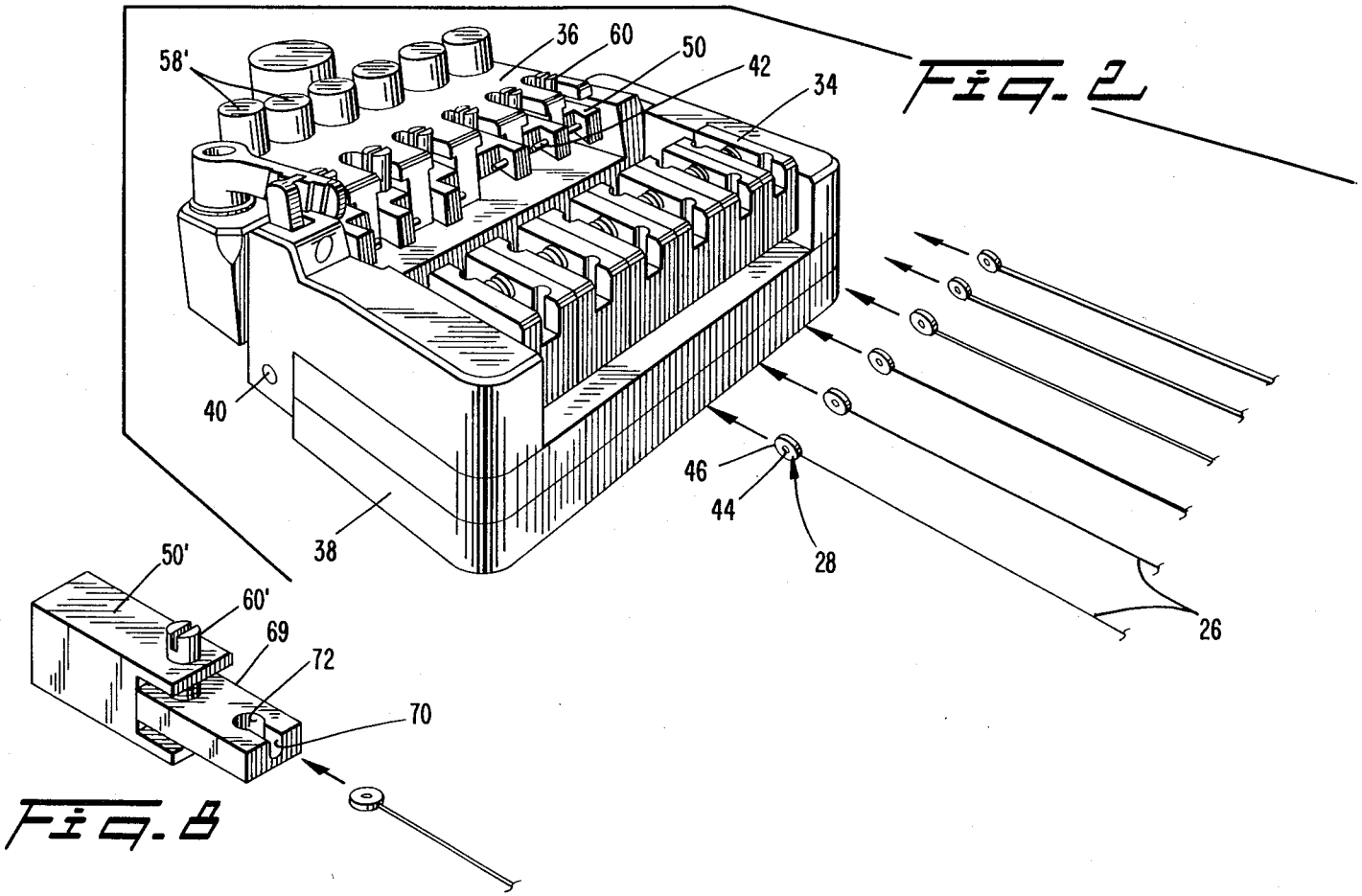
FIG. 2 is a perspective view of another embodiment of the tremolo tailpiece and strings illustrated in FIG. 1.
FIG. 8 is a perspective view of an alternative anchor member for the tremolo tailpiece shown in FIG. 2.

As shown in FIG. 2, the tremolo tailpiece 36 is mounted on a lower housing 38 which is bolted to the guitar body 22. The tailpiece 36 includes means, such as a pivot axle 40, for pivoting the tailpiece 36 relative to housing 38 and body 22 about a pivot point defined by axle 40. A handle 41 is secured to tremolo tailpiece 36 in a conventional manner to facilitate the pivoting of tailpiece 36.

The tailpiece 36 includes means for anchoring the body end 28 of each string 26 to the tremolo tailpiece 36 and for varying the absolute pitch of the strings while maintaining the relative pitch of the strings during pivoting of tailpiece 36. In this embodiment, the anchoring means includes polished anchor pins 42. Each polished pin 42 accommodates a hole 44 in a ball 46 fastened to the body end 28 of a string 26. The tremolo tailpiece 36 and strings 26 are shown in exploded view in FIG. 2 and in an assembled view in FIG. 1. Polished anchor pins 42 form a low friction bearing for the anchor balls 46 when the tailpiece 36 is pivoted around axle 40.

Anchor pins 42 are attached to slides 50 which in this case are threaded on screws 56. Knobs 58 are attached to screws 56 respectively, so that screws 56 cause slides 50 to move in a left-right direction as shown in FIG. 1 when knobs 58 are turned. This allows anchor pins 42 to be positioned relative to each other through the adjusting mechanism housed in tailpiece 36.

An alternative anchor member is shown in FIG. 8. Slide 50' in FIG. 8 corresponds to one of slides 50 in FIG. 1. However, rather than having a polished anchor pin, slide 50' has an auxiliary portion 69 with a channel 70 for accommodating a string 26 and a countersunk portion 72 which accommodates the body ball 46 of that string. Adjusting screw 60' positions the height of auxiliary portion 69 and therefore positions the height of the body ball 46 of a string for purposes discussed below.

Figure 3:
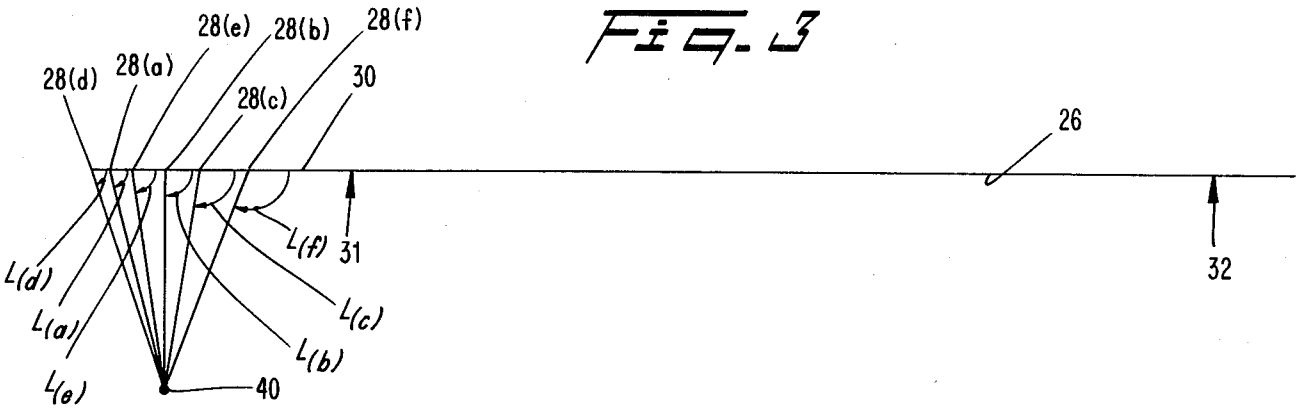
FIG. 3 is a schematic elevation view of strings shown in FIG. 1 mounted at different lever angles.

The anchoring arrangement varies the absolute pitch of the strings while maintaining the relative pitch of the strings during pivoting of tailpiece 36. This is accomplished by maintaining at least one string at a different lever angle relative to at least one of the other strings. As shown in FIG. 3, the relative positioning of anchor pins 42 form different lever angles. As used in the context of this invention, the "lever angle" of a string is defined as the angle formed between the body end portion 30 of a string and a line segment between the body end 28 of that string and the pivot point at axle 40.

Figure 7:
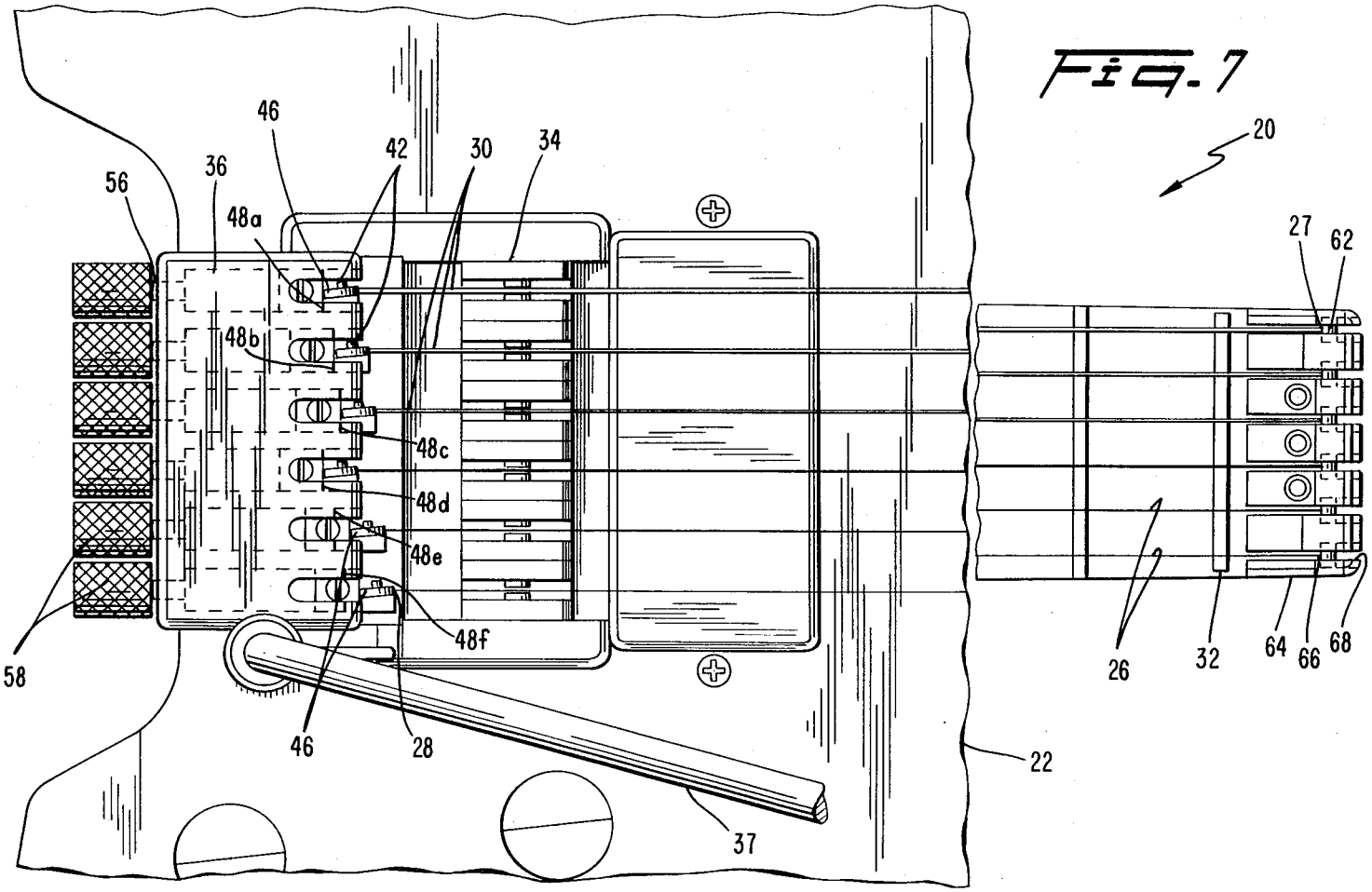
FIG. 7 is yet another embodiment incorporating the teachings of the present invention.

As shown in FIG. 7, tailpiece 36 contains markings 48(*a*) through 48 (*f*) which indicate the relative positioning of the anchor arrangement for each corresponding string 26(*a*) through 26(*f*). In such a manner, the corresponding body end 28(*a*) through 28(*f*) of strings 26(*a*) through 26(*f*) are positioned in staggered fashion across the width of tailpiece 36.

As shown schematically and in exaggerated fashion for clarity in the side view of FIG. 3, the body end 28 of each string is identified by a letter to correspond to its respective position marker 48. For example, body end 28(*a*) corresponds to position marker 48(*a*), and body end 28(*b*) to position marker 48(*b*). The lever angle L for each string is defined by corresponding letters. As shown in FIG. 3, lever angle L(*a*) corresponds to string 26(*a*) having body end 28(*a*), and lever angle L(*b*) corresponds to string 26(*b*) having body end 28(*b*).

Figure 4:
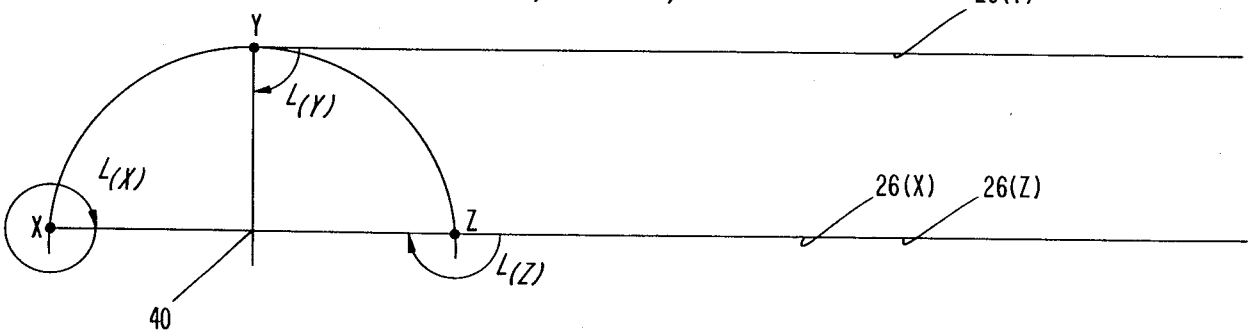
FIG. 4 is a geometric drawing illustrating the principle of different lever angles.

As will be seen from FIG. 4, both the rate of change of tension in a string, and the change in the rate of change of tension in a string vary as the lever angle of a string changes. In FIG. 4, the body end 28 of hypothetical strings 26(X), 26(Y) and 26(Z), are attached to points X, Y, and Z respectively on arc XYZ which is pivotable as a unit about point 40. Since the strings extend in a horizontal direction on the drawing, a string fixed to point Y would undergo a maximum change of tension relative to strings attached at other points as arc XYZ is rotated a small distance about pivot point 40. In contrast, strings fixed to points X and Z would undergo a minimum change in tension relative to strings attached at other points as arc XYZ is rotated a small distance about pivot point 40. This is because a string fixed at point Y is displaced solely in the horizontal direction along the string. In contrast, strings fixed at points X and Z would be displaced solely in the vertical direction transverse to the string and thereby undergo no displacement in the horizontal direction along the string.

A continuously varying rate of change of tension is possible depending on the lever angle of the string, from a minimum at a lever angle shown as L(Z) increasing to a maximum at a lever angle shown as L(Y), and then decreasing again to a minimum at a lever angle shown as L(X). The positioning of strings at different lever angles constitutes means for maintaining a rate of change of tension in at least one of the strings which is different from a rate of change of tension in at least one of the other strings when tailpiece 36 is pivoted around pivot point 40. Also, the positioning of strings at different lever angles constitutes means for maintaining a change in the rate of change of tension in at least one string which is different from the change in the rate of change of tension in at least one of the other strings.

In addition, the positioning of strings at different lever angles constitutes means for maintaining a rate of change of tension in at least one string relative to a rate of change of tension in at least one other string at a ratio which varies throughout the range of pivoting positions. As shown in FIG. 4, as a string progresses from point Z to point Y there is an increasing rate of change of tension during pivoting of the tremolo tailpiece. Therefore, it is seen that the disclosed arrangement of the anchor members at different lever angles constitutes means for maintaining a rate of change of tension in at least one string relative to a rate of change in tension in at least one other string at a ratio which varies throughout the range of pivoting positions.

In summary, by positioning strings at different lever angles, the parameters discussed above can be adjusted to accommodate the particular pitch and tension characteristics of the different strings. In so doing, the tremolo system allows a user to vary the absolute pitch of the strings while maintaining the relative pitch of the strings during pivoting of the tremolo tailpiece to a degree of precision not previously possible. There are several significant embodiments of the invention which will now be discussed.

First Embodiment

Figure 5:
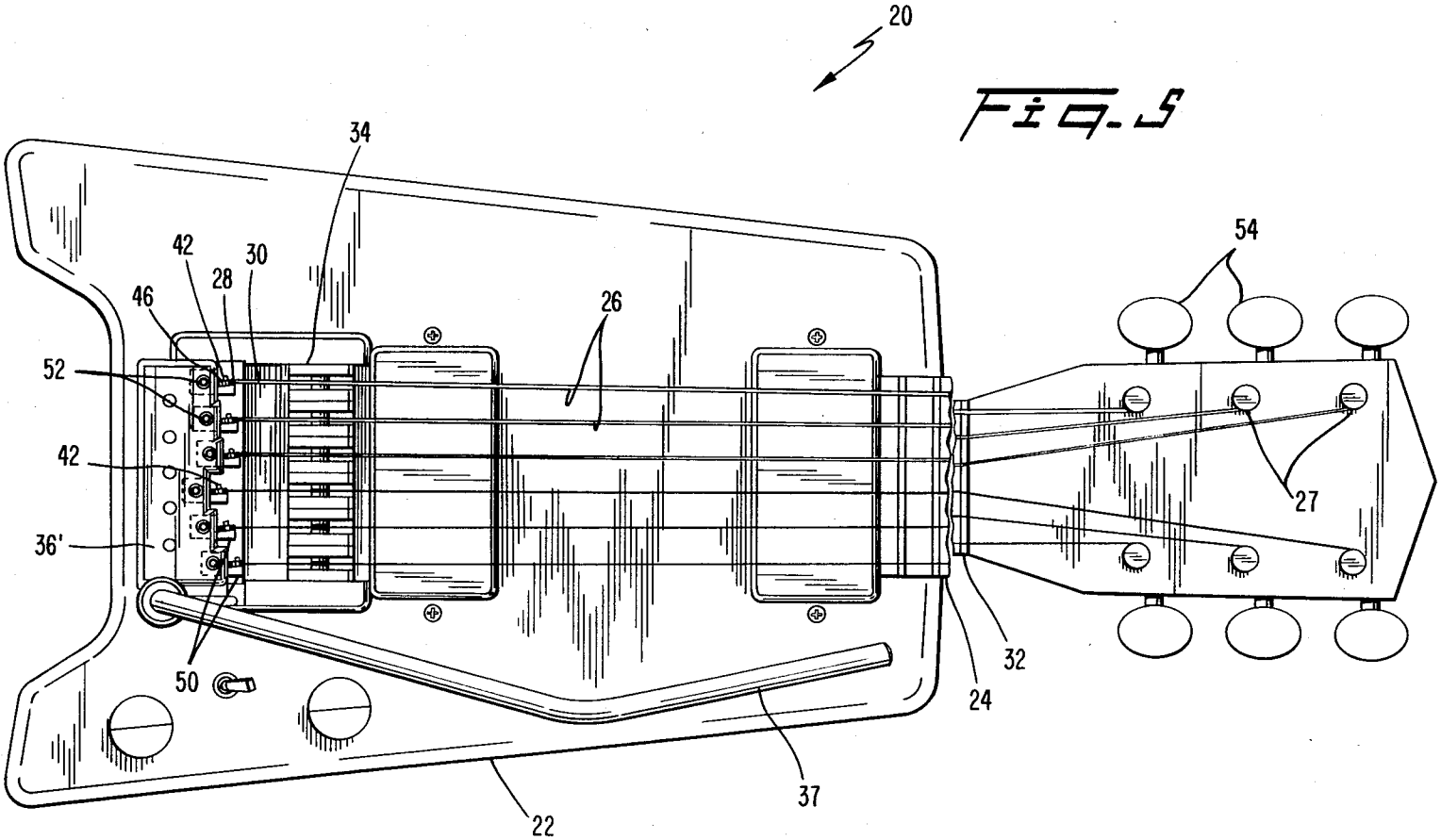
FIG. 5 is a plan view of another embodiment incorporating the teachings of the present invention.

As shown in FIG. 5, a first embodiment includes an arrangement in which anchor pins 42 are fixed relative to each other so that the lever angles of the strings are also fixed relative to each other. In such an arrangement, pins 42 extend from slides 50, which are in nonadjustably fixed on tailpiece 36 relative to each other. Bolts 52 are provided to fix slides 50 onto tailpiece 36. Body ends 28 of strings 26 can be fixed to pins 42 through the use of ball ends 46, as shown in FIG. 1, or by other means. As can be seen from FIG. 5, the anchor pins 42 are permanently fixed in optimum relative positions at different lever angles relative to each other to achieve the purposes of the invention.

It is seen that in such an arrangement, the system comprises a plurality of strings 26 extending over at least a portion of body 22, each string having a neck end 27, a body end 28, and body end portion 30 extending from the body end 28; a body ball 46 fastened to the body end 28 of each string 26; and nut means 32 on the neck 24 for defining the neck end of the vibrating portion of the strings 26. Bridge units 34 on the body define the body end of the vibrating portion of the strings, and tuning system means such as conventional capstan tuning pegs 54 on the neck 24 of the instrument secure the neck end 27 of each string to the neck of the instrument. A tremold tailpiece 36 mounted on the body 22, includes means for pivoting the tailpiece 36 relative to the body 22 about a pivot point similar to that shown in FIG. 2. Means are also provided for anchoring the body end 28 of each string to the tremolo tailpiece 36 and for varying the absolute pitch of the strings while maintaining the relative pitch of the strings during pivoting of the tailpiece 36. In this case, the anchoring means includes anchor pins 42 which are fixed in place at different relative lever angles. In such an arrangement, capstan tuning pegs 54 are the sole means for tuning the strings of the instrument.

Second Embodiment

Figure 6:
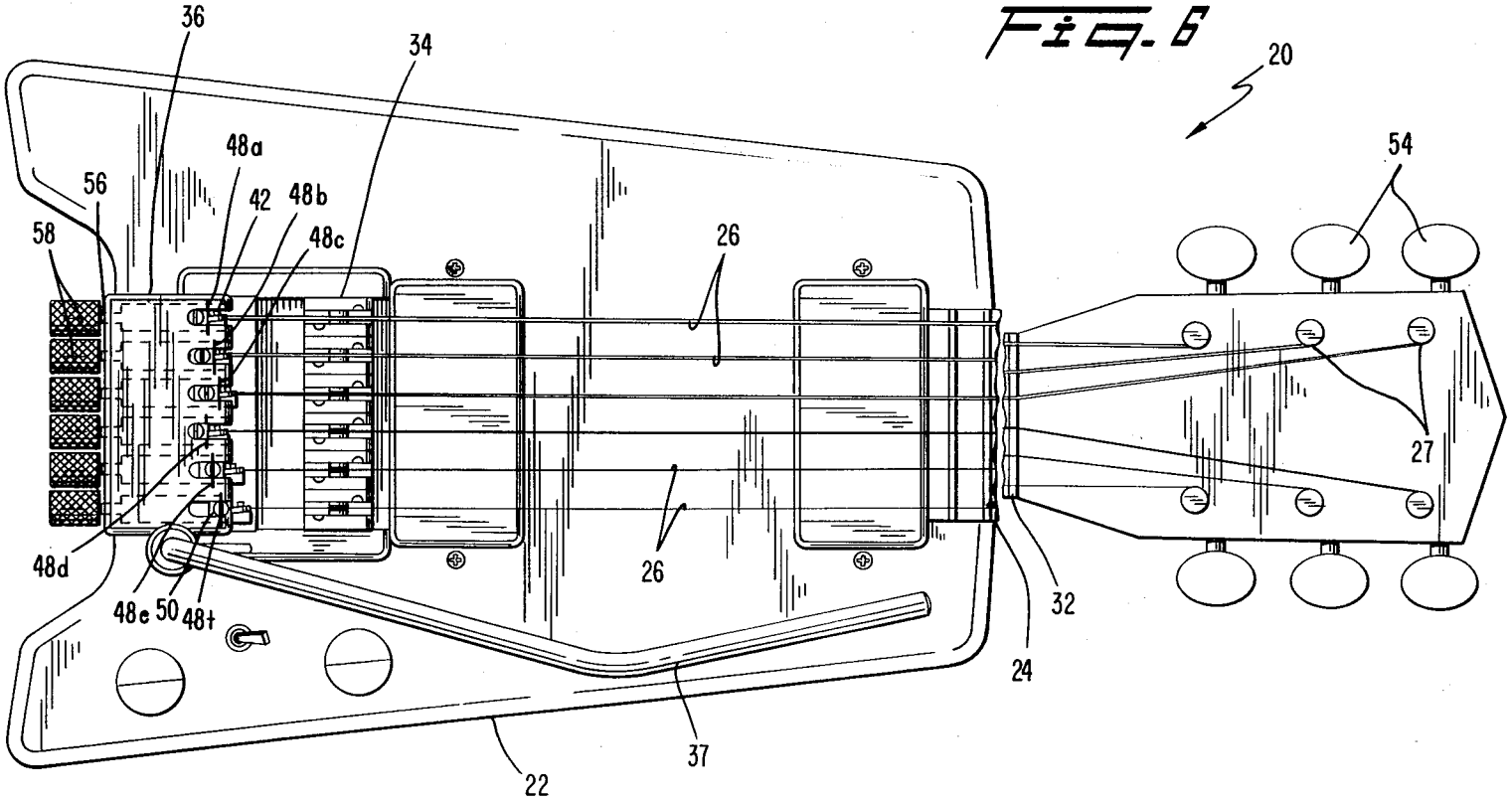
FIG. 6 is a further embodiment incorporating the teachings of the present invention.

The second embodiment is shown in FIG. 6. Like the first embodiment shown in FIG. 5, capstan tuning pegs 54 comprise the tuning system means on the neck of the instrument for securing the neck end 27 of each string to the neck 24 of the instrument. However, like the arrangement shown in FIG. 1, the anchor means is adjustable so that the lever angle of at least one string is adjustable relative to the lever angle of at least one of the other strings.

Anchor pins 42 are attached to slides 50, which in this case are threaded on screws 56. Knobs 58 are attached to screws 56 respectively, so that screws 56 cause slides 50 to move in a left-right direction as shown in FIG. 6 when knobs 58 are turned. Therefore, anchor pins 42 can be positioned at different locations relative to each other through the adjusting mechanism housed in tailpiece 36. This allows the strings to be adjustably positioned at different lever angles.

Capstan tuning mechanism 54 also can be used to fine tune the strings. Knobs 58, while primarily serving as a mechanism for adjusting the lever angles of the strings, can also be used as a secondary tuning system. The tremolo tailpiece 36, shown in FIG. 6 also can be adjustable to position the body end of the strings in the direction transverse to the extent of the strings. This is most easily seen in FIG. 2. Adjusting screws 60 can raise and lower slide 50 of the anchor arrangement for the body end of each string, and thereby raise and lower pins 42. This adjustment mechanism gives even more flexibility and precision in adjusting the relative change in tension of the strings. The knobs 58 can be located either on the far end of the tremolo tailpiece 36 as shown in FIG. 1 as knobs 58, or on top of the tremolo tailpiece as shown in FIG. 2 as knobs 58'.

Third Embodiment

A third embodiment is shown in FIG. 7. This embodiment includes a plurality of double ball ended strings of different relative lengths. Each string has a neck ball 62 fastened to the neck end 27 of each string, a body ball 46 fastened to the body end 28 of each string, nut means 32 on the neck for defining the neck end of the vibrating portion of the strings, a bridge unit 34 on the body 22 for defining the body end of the vibrating portion of the strings, and means such as headpiece 64 for securing the neck ball end of each string to the neck 24 of the instrument so that the neck ball 62 of each string is the same distance from the nut means 32.

As shown in FIG. 7, headpiece 64 includes a plate having channels 66 for accommodating the strings and a countersunk portion 68 for each channel 66. The countersunk portion 68 accommodates the neck ball 62 for a given string and prevents it from sliding into channel 66. The portion of the countersunk areas 68 against which the neck balls 62 rest are all the same distance from the nut means 32, so that the distance between each neck ball 62 and the nut means 32 is the same.

The strings in this embodiment have different relative lengths, so that the body end 28 of each string is positioned at a point where it can be anchored at the appropriate lever angle by anchor pins 42.

Fourth Embodiment

The arrangement shown in FIG. 1 is similar to the arrangement shown in FIG. 7, except that the double ball ended strings are of equal length, and the headpiece 64' has countersunk portions 68' of varying depths. This arrangement provides the same effect as the arrangement shown in FIG. 7, which uses countersunk portions 68 of the same depth, with strings of differing length. The body end of each string is located at a point where it can be anchored at the appropriate lever angle by anchor pins 42.

In such an arrangement, knobs 58 are used to tune the strings. These knobs 58 would not be required to set the position of the lever angle of the strings, since this automatically would be done by using double ball ended strings of preset lengths with the appropriate head piece. This advantage is shared by the embodiment shown in FIG. 7.

In contrast, the embodiments shown in FIGS. 5 and 6 use single ball ended strings in which the body ball ends are either preset at the proper lever angles, as shown in FIG. 5, or adjusted to predetermined or selected lever angle positions through the use of knobs 58, as shown in FIG. 6. In this case all tuning can be accomplished with conventional capstan tuners. It should also be noted that it is possible to use strings without balls on either end with the invention.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the applicant's general inventive concept.

What is claimed is:

1. An even tuning tremolo system for a stringed musical instrument having a body, a neck extending from the body, and strings having a neck end, a body end, and different pitch and tension characteristics relative to each other, comprising:

nut means on the neck and bridge means on the body for generally defining a string plane and a vibrating portion of the strings which extend in a longitudinal direction in the string plane;

a tremolo tailpiece mounted on the body, the tailpiece including means for pivoting the tailpiece within a range of pivoting positions relative to the body about a pivot axis, said pivot axis being generally parallel to but spaced from the string plane and generally oriented transverse to the longitudinal direction; and a plurality of individual anchor means, each individual anchor means for anchoring the body end of a respective string to the tremolo tailpiece at a respective selected position, the respective selected position of at least one individual anchor means being spaced in the longitudinal direction from the respective selected position of at least one other individual anchor means, the respective selected position of said at least one individual anchor means and the pivot axis of the tremolo tailpiece defining a first plane oriented relative to the string plane at a first angle, the respective selected position of said at least one other individual anchor means and the pivot axis of the tremolo tailpiece defining a second plane oriented relative to the string plane at a second angle which is different from the first angle for maintaining the relative pitch of the strings while varying the absolute pitch of the strings during pivoting of the tailpiece.

2. An even tuning tremolo system as claimed in claim 1 including a plurality of longitudinal adjustment means, each longitudinal adjustment means for adjusting the position of a respective individual anchor means relative to the position of the other individual anchor means generally in the longitudinal direction.

3. An even tuning tremolo system as claimed in claim 2 wherein each longitudinal adjustment means includes a threaded adjustment screw.

4. An even tuning tremolo system as claimed in claim 2 including a plurality of transverse adjustment means, each transverse adjustment means for adjusting the position of a respective individual anchor means relative to the position of the other individual anchor means in a direction transverse to the longitudinal direction.

5. An even tuning tremolo system as claimed in claim 1 wherein the selected positions of the anchor means are permanently fixed relative to each other.

6. An even tuning tremolo system as claimed in claim 1 including a plurality of body balls, each body ball fastened to the body end of a respective string, each body ball having an aperture, and each individual anchor means including pin means positioned in the aperture of a respective body ball for permitting relative rotation between each pin means and respective body ball when the tailpiece is pivoted about the tailpiece pivot axis.

7. An even tuning tremolo system for a stringed musical instrument, the instrument having a body and a neck extending from the body, the system comprising:

a plurality of strings of substantially equal length extending over at least a portion of the body, each string having a neck end, a body end, and different pitch and tension characteristics relative to each other;

a neck ball fastened to the neck end of each string;

a body ball fastened to the body end of each string;

nut means on the neck and bridge means on the body for generally defining a string plane and a vibrating portion of the strings which extend in a longitudinal direction;

means for securing the neck end of each string to the neck of the instrument, the neck ball of at least one string being secured at a different distance from the nut means relative to the neck ball of at least one other string;

a tremolo tailpiece mounted on the body, the tailpiece including means for pivoting the tailpiece relative to the body about a pivot axis, said pivot axis being generally parallel to but spaced from the string plane and generally oriented transverse to the longitudinal direction; and a plurality of individual anchor means, each individual anchor means for anchoring the body end of a respective string to the tremolo tailpiece at a respective selected position, the respective selected position of at least one individual anchor means being spaced in the longitudinal direction from the respective selected position of at least one other individual anchor means, the respective selected position of said at least one individual anchor means and the pivot axis of the tremolo tailpiece defining a first plane oriented relative to the string plane at a first angle, the respective selected position of said at least one other individual anchor means and the pivot axis of the tremolo tailpiece defining a second plane oriented relative to the string plane at a second angle which is different from the first angle for maintaining the relative pitch of the strings while varying the absolute pitch of the strings during pivoting of the tailpiece.

8. An even tuning tremolo system as claimed in claim 7 including a plurality of longitudinal adjustment means, each longitudinal adjustment means for adjusting the position of a respective individual anchor means relative to the position or the other individual anchor means generally in the longitudinal direction.

9. An even tuning tremolo system as claimed in claim 8 wherein each longitudinal adjustment means includes a threaded adjustment screw.

10. An even tuning tremolo system as claimed in claim 8 including a plurality of transverse adjustment means, each transverse adjustment means for adjusting the position of a respective individual anchor means relative to the position of the other individual anchor means in a direction transverse to the longitudinal direction.

11. An even tuning tremolo system as claimed in claim 7 wherein the selected positions of the anchor means are permanently fixed relative to each other.

12. An even tuning tremolo system for a stringed musical instrument, the instrument having a body and a neck extending from the body, the system comprising:

a plurality of strings of different relative lengths extending over at least a portion of the body, each string having a neck end, a body end, and different pitch and tension characteristics relative to each other;

a neck ball fastened to the neck end of each string;

a body ball fastened to the body end of each string;

nut means on the neck and bridge means on the body for generally defining a string plane and a vibrating portion of the strings which extend in a longitudinal direction;

means for securing the neck end of each string to the neck of the instrument at essentially an equal distance from the nut means;

a tremolo tailpiece mounted on the body, the tailpiece including pivot means for pivoting the tremolo tailpiece relative to the body about a pivot axis, said pivot axis being generally parallel to but spaced from the string plane and generally oriented transverse to the longitudinal direction; and a plurality of individual anchor means, each individual anchor means for anchoring the body end of a respective string to the tremolo tailpiece at a respective selected position, the respective selected position of at least one individual anchor means being spaced in the longitudinal direction from the respective selected position of at least one other individual anchor means, the respective selected position of said at least one individual anchor means and the pivot axis of the tremolo tailpiece defining a first plane oriented relative to the string plane at a first angle, the respective selected position of said at least one other individual anchor means and the pivot axis of the tremolo tailpiece defining a second plane oriented relative to the string plane at a second angle which is different from the first angle for maintaining the relative pitch of the strings while varying the absolute pitch of the strings during pivoting of the tailpiece.

13. An even tuning tremolo system as claimed in claim 12 including a plurality of longitudinal adjustment means, each longitudinal adjustment means for adjusting the position of a respective individual anchor means relative to the position of the other individual anchor means generally in the longitudinal direction.

14. An even tuning tremolo system as claimed in claim 13 wherein each longitudinal adjustment means includes a threaded adjustment screw.

15. An even tuning tremolo system as claimed in claim 13 including a plurality of transverse adjustment means, each transverse adjustment means for adjusting the position of a respective individual anchor means relative to the position of the other individual anchor means in a direction transverse to the longitudinal direction.

16. An even tuning tremolo system as claimed in claim 12 wherein the selected positions of the anchor means are permanently fixed relative to each other.

17. An even tuning tremolo system for a stringed musical instrument, the instrument having a body and a neck extending from the body, the system comprising:

a plurality of strings extending over at least a portion of the body, each string having a neck end, a body end, and different pitch and tension characteristics relative to each other;

a body ball fastened to the body end of each string;

nut means on the neck and bridge means on the body for generally defining a string plane and a vibrating portion of the strings which extend in a longitudinal direction;

tuning system means on the neck of the instrument for securing the neck end of each string to the neck of the instrument;

a tremolo tailpiece mounted on the body, the tailpiece including means for pivoting the tailpiece relative to the body about a pivot axis, said pivot axis being generally parallel to but spaced from the string plane and generally oriented transverse to the longitudinal direction; and a plurality of individual anchor means, each individual anchor means for anchoring the body end of a respective string to the tremolo tailpiece at a respective selected position, the respective selected position of at least one individual anchor means being spaced in longitudinal direction from the respective selected position of at least one other individual anchor means, the respective selected position of said at least one individual anchor means and the pivot axis of the tremolo tailpiece defining a first plane oriented relative to the string plane at a first angle, the respective selected position of said at least one other individual anchor means and the pivot axis of the tremolo tailpiece defining a second plane oriented relative to the string plane at a second angle which is different from the first angle for maintaining the relative pitch of the strings while varying the absolute pitch of the strings during pivoting of the tailpiece.

18. An even tuning tremolo system as claimed in claim 17 including a plurality of longitudinal adjustment means, each longitudinal adjustment means for adjusting the position of a respective individual anchor means relative to the position of the other individual anchor means generally in the longitudinal direction.

19. An even tuning tremolo system as claimed in claim 18 wherein each longitudinal adjustment means includes a threaded adjustment screw.

20. An even tuning tremolo system as claimed in claim 18 including a plurality of transverse adjustment means, each transverse adjustment means for adjusting the position of a respective individual anchor means relative to the position of the other individual anchor means in a direction transverse to the longitudinal direction.

21. An even tuning tremolo system as claimed in claim 17 wherein the selected positions of the anchor means are permanently fixed relative to each other.

* * * * *